US010233923B2

(12) United States Patent
Tonami et al.

(10) Patent No.: US 10,233,923 B2
(45) Date of Patent: Mar. 19, 2019

(54) SLIDING MEMBER FOR PUMP AND PUMP OPERATION STATE DETECTION SYSTEM

(71) Applicant: HEISHIN TECHNO WERKE LTD., Kobe-shi, Hyogo (JP)

(72) Inventors: Masahiro Tonami, Kobe (JP); Yuko Katayama, Kobe (JP)

(73) Assignee: HEISHIN TECHNO WERKE LTD., Kobe-shi (JP)

( * ) Notice: Subject to any disclaimer, the term of this patent is extended or adjusted under 35 U.S.C. 154(b) by 243 days.

(21) Appl. No.: 14/913,243

(22) PCT Filed: Jul. 10, 2014

(86) PCT No.: PCT/JP2014/068470
§ 371 (c)(1),
(2) Date: Feb. 19, 2016

(87) PCT Pub. No.: WO2015/025635
PCT Pub. Date: Feb. 26, 2015

(65) Prior Publication Data

US 2016/0201667 A1 Jul. 14, 2016

(30) Foreign Application Priority Data

Aug. 20, 2013 (JP) ..... 2013-170244

(51) Int. Cl.
*F01C 1/10* (2006.01)
*F03C 2/00* (2006.01)
(Continued)

(52) U.S. Cl.
CPC ..... *F04C 2/1073* (2013.01); *F04C 2/1075* (2013.01); *F04C 14/28* (2013.01);
(Continued)

(58) Field of Classification Search
CPC ..... F04C 2/1073; F04C 2/1075; F04C 14/28; F04C 2240/81; F04C 2270/80;
(Continued)

(56) References Cited

U.S. PATENT DOCUMENTS

2008/0025859 A1* 1/2008 Lee ..... F04C 2/1075 418/48

FOREIGN PATENT DOCUMENTS

JP 55-156403 A 5/1977
JP S62-29781 A 2/1987
(Continued)

OTHER PUBLICATIONS

ISA/JPO, Authorized officer Kazuhiko Kato, International Search Report dated Sep. 16, 2014 in International Application No. PCT/JP2014/068470, total 4 pages with English translation.

*Primary Examiner* — Theresa Trieu
(74) *Attorney, Agent, or Firm* — Masuvalley & Partners

(57) ABSTRACT

Provided are a sliding member for pumps in which generation of a wear substance is quickly and accurately grasped even if the wear substance is generated when the sliding member slides while being in contact with another member, and a pump operation state detection system using the sliding member. The pump operation state detection system includes a uniaxial eccentric screw pump, a detection device capable of detecting metal powder in a fluid discharged from the uniaxial eccentric screw pump, and a determination device. In the uniaxial eccentric screw pump, a stator is arranged so as to be exposed to a fluid conveyance path through which the fluid flows. The stator is configured to slide while being in contact with a rotor along with operation of the uniaxial eccentric screw pump. The stator is made of a resin or a rubber and contains 10-30% of metal powder by weight ratio.

13 Claims, 5 Drawing Sheets

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 2/107*** | (2006.01) |
| ***F04C 14/28*** | (2006.01) |

(52) U.S. Cl.
CPC .... *F04C 2240/81* (2013.01); *F04C 2270/165* (2013.01); *F04C 2270/80* (2013.01); *F05C 2253/20* (2013.01)

(58) Field of Classification Search
CPC ..... F04C 2270/165; F04C 15/0245; F05C 2225/10; F05C 2225/02; F05C 2253/20; B21C 1/28; F04D 15/02; F04D 15/0245; B22F 1/025
USPC ..... 418/48, 152, 178–179
See application file for complete search history.

(56) References Cited

FOREIGN PATENT DOCUMENTS

| | | | |
|---|---|---|---|
| JP | H06-229476 | A | 8/1994 |
| JP | H10-281077 | A | 10/1998 |
| JP | 2000-087873 | A | 3/2000 |
| JP | 2000-509125 | A | 7/2000 |
| JP | 2003-306217 | A | 10/2003 |
| JP | 2004-224557 | A | 8/2004 |
| JP | 2006-283643 | A | 10/2006 |
| JP | 2008-175199 | A | 7/2008 |
| JP | 2010-248978 | A | 11/2010 |
| JP | 2010-281280 | A | 12/2010 |

* cited by examiner

SLIDING MEMBER FOR PUMP AND PUMP OPERATION STATE DETECTION SYSTEM

This application is the U.S. National Phase of International Application No. PCT/JP2014/068470 filed on Jul. 10, 2014, entitled "*Sliding Member for Pump and Pump Operation State Detection System*" and claims priority to Japanese Patent Application No. 2013-170244, filed on Aug. 20, 2013, which are hereby expressly incorporated by reference in their entirety for all purposes.

TECHNICAL FIELD

The present invention generally relates to a sliding member and, but not by way of limitation, to a sliding member for pumps, which is used as a pump, and to a pump operation state detection system capable of detecting wear of the sliding member caused in the pump.

BACKGROUND ART

Hitherto, there has been provided a pump such as a uniaxial eccentric screw pump as disclosed in Patent Literature 1 (JP 2008-175199 A). The uniaxial eccentric screw pump is capable of force-feeding a fluid having a high viscosity, such as starch syrup, a fluid that is prone to alteration and is required to be handled carefully, a fluid containing a solid, fibers, air bubbles, as well as a fluid having a low viscosity, such as a liquid. Therefore, the uniaxial eccentric screw pump can also be used suitably for force-feeding food and the like.

Here, the above-mentioned uniaxial eccentric screw pump exerts a pump action through rotation of a male-screw-shaped rotor in a stator having a female-screw-shaped insertion hole. Further, as in the case of the stator in the uniaxial eccentric screw pump, a sliding member configured to slide while being in contact with another member (rotor in the uniaxial eccentric screw pump) along with operation of the pump may be arranged so as to be exposed to a flow path through which a fluid to be force-fed flows. Therefore, when a pump such as a uniaxial eccentric screw pump is used in an unintended usage form to apply an excessive load to the stator and the rotor, there is a risk in that a wear substance and a flake of the sliding member may be generated and mixed in the fluid.

Therefore, there is a demand for providing a sliding member for pump in which even the use of the sliding member in such a state that a wear substance and the like are generated, as described above, can be quickly and accurately grasped, and for providing a pump operation state detection system including the sliding member. In particular, in a pump capable of force-feeding food and the like as in the above-mentioned uniaxial eccentric screw pump, there is a strong demand for quickly and accurately detecting the mixing of a wear substance and the like in the fluid.

In view of the foregoing, it is an object of the present invention to provide a sliding member in which generation of a wear substance and the like can be quickly and accurately grasped even if the wear substance and the like are generated when the sliding member slides while being in contact with another member, and to provide a pump operation state detection system for a pump using the sliding member.

SUMMARY OF THE INVENTION

In order to solve the above-mentioned problem, according to an embodiment of the present invention, there is provided a sliding member for pumps, which is arranged so as to be exposed to a flow path of a fluid in the pump, and is configured to slide while being in contact with another member along with operation of the pump. The sliding member may include a resin or a rubber, and 10% to 30% of metal powder in terms of a weight ratio.

In this embodiment, the sliding member is made of a resin or a rubber and contains 10% to 30% of metal powder in terms of a weight ratio. With such configuration, even if a wear substance and a flake of the sliding member are generated and mixed in the fluid flowing through the flow path due to the use of the sliding member in an unintended usage form and the like, the mixing of a wear substance can be quickly and accurately detected through the use of a detection device capable of detecting the presence of the metal powder, as typified by a metal detector and an X-ray foreign matter inspection machine.

The above-mentioned sliding member according to the embodiments of the present invention may be suitably used as a stator in a uniaxial eccentric screw pump. The uniaxial eccentric screw pump may include a rotor which is formed into a male screw shape and is configured to receive power to eccentrically rotate. The stator may have an inner peripheral surface formed into a female screw shape and having the flow path formed in the stator.

As described above, the stator of the uniaxial eccentric screw pump is a sliding member in which the rotor formed into a male screw shape and is inserted so as to eccentrically rotate and be exposed to the flow path formed therein. Therefore, according to the one embodiment of the present invention, even when a wear substance and a flake of the stator serving as the sliding member in the uniaxial eccentric screw pump are generated and mixed in the fluid to be force-fed, the presence/absence of the mixing of a wear substance and a flake can be quickly and accurately detected through detection of the location of the metal powder by a detection device such as a metal detector and an X-ray foreign matter inspection machine.

In the above-mentioned sliding member according to a preferred embodiment of the present invention, the stator may have a tapered end surface on a discharge side and/or a suction side of the fluid in the stator.

With such configuration, cracks can be prevented from being formed by the influence of a discharge pressure or a suction pressure on the end surface on the discharge side and/or the suction side of the stator.

According to the preferred embodiment of the present invention, in the above-mentioned sliding member, the resin or the rubber may have a constant thickness.

Even in the case of such configuration, through use of the detection device capable of detecting the presence of the metal powder, the mixing of a wear substance containing the metal powder can be quickly and accurately detected.

Here, in the above-mentioned sliding member, it is considered that there is a high risk in that a wear substance and a flake are generated and mixed in the fluid in the vicinity of a sliding surface configured to slide while being in contact with another member, and there is a low risk in that a wear substance and the like are generated in a region away from the sliding surface.

Based on such findings, the sliding member according to the embodiments of the present invention, may have a sliding surface configured to slide while being in contact with another member, and a content of the metal powder is higher in a region on the sliding surface side than in other regions.

With such configuration, the other regions excluding the region on the sliding surface side is allowed to contain a small amount of the metal powder and not to be broken easily while the mixing of a wear substance and the like can be detected through the use of the detection device capable of detecting the presence of the metal powder. Further, with the above-mentioned configuration, the region on the sliding surface side and the other regions may be formed of different materials.

In yet another embodiment, there is provided a pump operation state detection system that includes: a pump having the above-mentioned sliding member; a detection device capable of detecting presence of metal powder contained in the fluid discharged from the pump; and a control device capable of determining that a wear substance generated along with wear of the stator is mixed in the fluid discharged from the pump under a condition that the detection device detects the presence of the metal powder.

In the pump operation state detection system according to the embodiments of the present invention, the sliding member containing 10% to 30% of metal powder in terms of a weight ratio is used. Further, in the pump operation state detection system, the detection device capable of detecting the presence of the metal powder, as typified by a metal detector and an X-ray foreign matter inspection machine, is arranged in at least a part of a conveyance path through which the fluid is conveyed. With this, it can be quickly and accurately detected whether or not a wear substance and the like are mixed in the fluid under the condition that the detection device detects the metal powder.

Thus, according to the embodiments of the present invention, it becomes possible to provide a sliding member in which the generation of a wear substance and the like can be quickly and accurately grasped even if the wear substance and the like are generated when the sliding member slides while being in contact with another member. And also, it becomes possible to provide the pump operation state detection system for a pump using said sliding member.

BRIEF DESCRIPTION OF THE DRAWINGS

The present disclosure is described in conjunction with the appended figures.

DETAILED DESCRIPTION OF THE INVENTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment(s) of the disclosure. It should be understood that various changes may be made in the function and arrangement of elements without departing from the spirit and scope of the invention as set forth in the appended claims.

In what follows, an embodiment in which a sliding member for a pump and a pump operation state detection system of the present invention are applied will be described. A pump operation state detection system 10 described in this embodiment is configured to detect an operation state of the pump, more specifically, whether or not a wear substance and a flake of the sliding member for pump, which is arranged in the pump, are generated, to thereby determine the presence/absence of abnormality.

Figure 1:
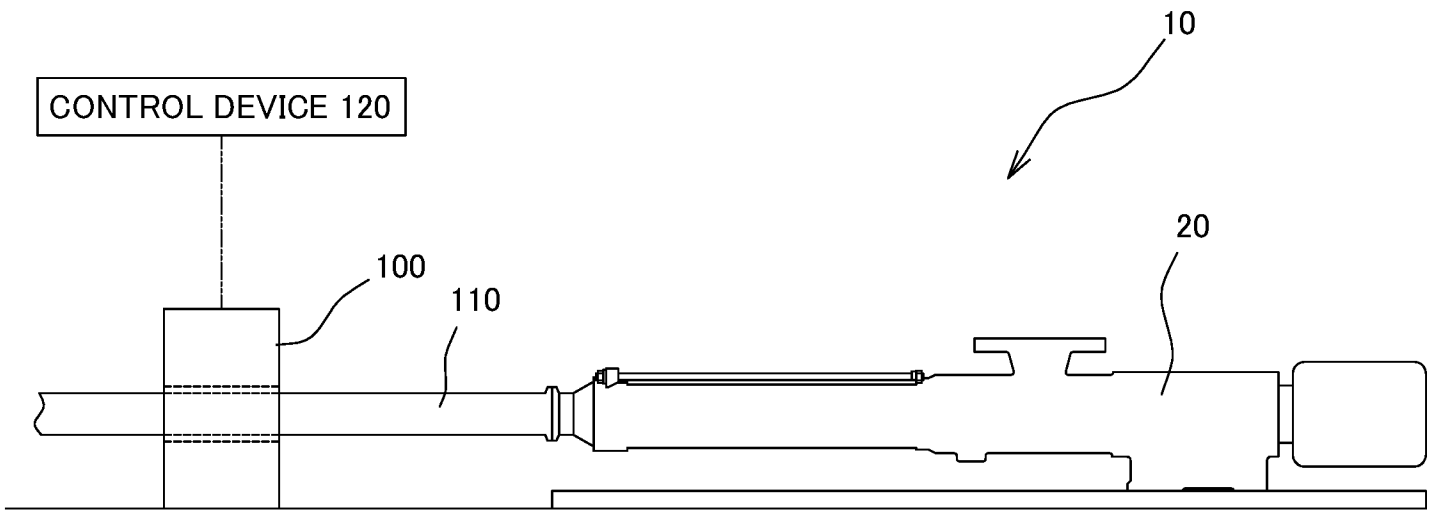
FIG. 1 is a configuration view for illustrating a pump operation state detection system according to one embodiment of the present invention.

Referring first to FIG. 1, an exemplary embodiment of the pump operation state detection system 10 is shown. The pump operation state detection system 10 may include a uniaxial eccentric screw pump 20 as the pump, and can detect a wear substance and the like by a detection device 100 and determine the presence/absence of operation abnormality by a control device 120. More specifically, the pump operation state detection system 10 has features and operation controls of a stator 50 serving as the sliding member for pump, a detection device 100, and a control device 120. Prior to description of the detailed configurations and operation controls of the stator 50, first an overview of the configuration of the uniaxial eccentric screw pump 20 is described.

<<Schematic Configuration of Uniaxial Eccentric Screw Pump 20>>

Figure 2:
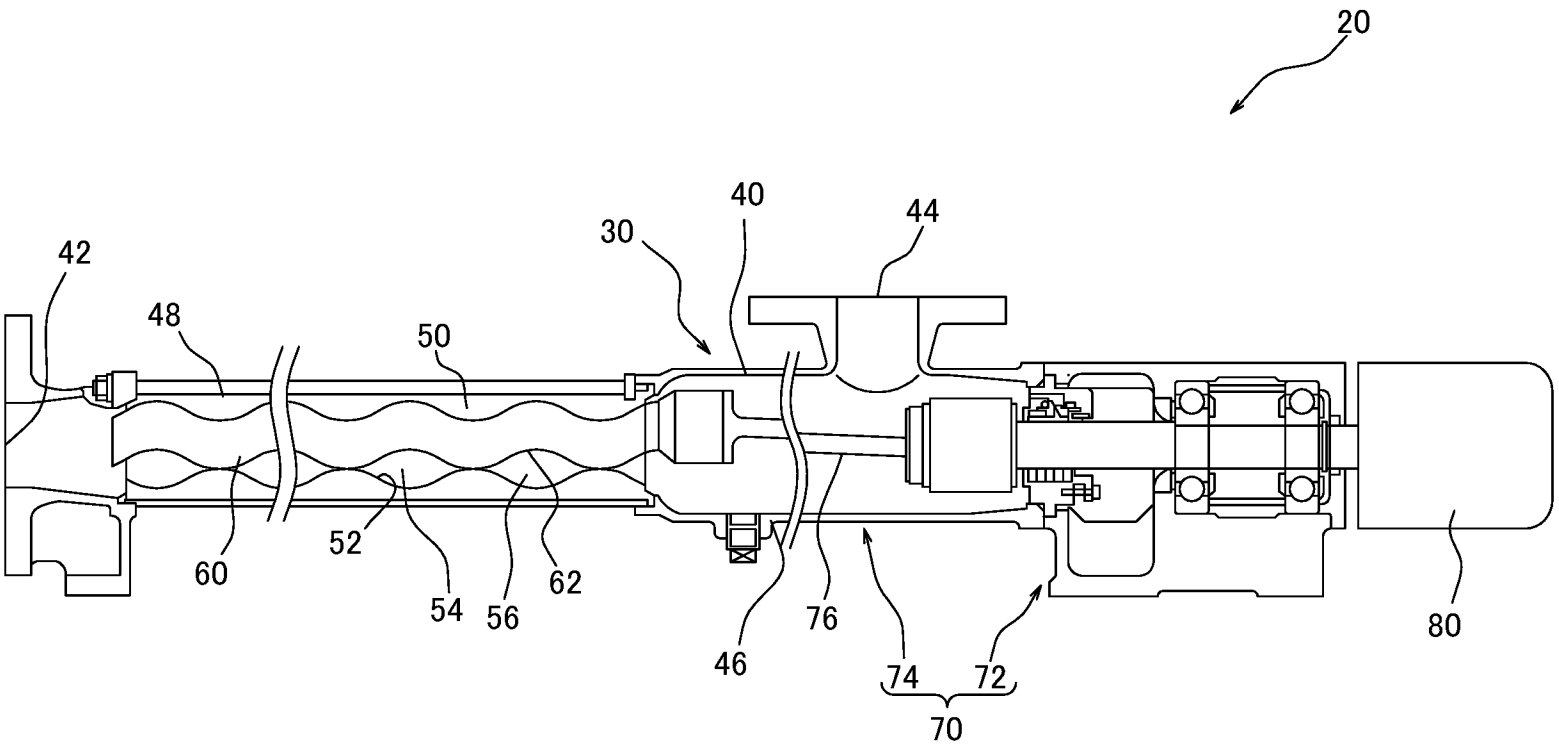
FIG. 2 is a cross-sectional view of a uniaxial eccentric screw pump arranged in the pump operation state detection system illustrated in FIG. 1.

FIG. 2 illustrates an embodiment of the uniaxial eccentric screw pump 20, a so-called rotary displacement pump, in detail. As shown in this figure, the uniaxial eccentric screw pump 20 may include a uniaxial eccentric screw pump mechanism 30 as its main component. As illustrated in FIG. 2, the stator 50, a rotor 60, and a power transmission mechanism 70 are accommodated in a casing 40. The casing 40 is a tubular member made of a metal, and has a first opening 42 formed at one end in a longitudinal direction. Further, a second opening 44 is formed in an outer peripheral portion of the casing 40. The second opening 44 communicates to an internal space of the casing 40 in an intermediate part 46 positioned in an intermediate portion in the longitudinal direction of the casing 40.

The first opening 42 and the second opening 44 respectively serve as a suction port and a discharge port of the pump mechanism 30. In the uniaxial eccentric screw pump 20, when the rotor 60 is rotated in a forward direction, the first opening 42 is allowed to serve as the discharge port, and the second opening 44 is allowed to serve as the suction port. Further, when the rotor 60 is rotated in a backward direction, the first opening 42 is allowed to serve as the suction port, and the second opening 44 is allowed to serve as the discharge port.

The stator 50 is a member having a substantially cylindrical external appearance formed of a material containing an elastic body such as a rubber or a resin as a main component. An inner peripheral surface 52 of the stator 50 is a member formed into an (n+1)-thread (n=1 in this embodiment) female screw shape. Further, a through hole 54 of the stator 50 is formed so that a cross-sectional shape (opening shape) thereof becomes a substantially oval shape in sectional view at any position in the longitudinal direction of the stator 50. Further, the stator 50 is tapered in both end portions on the discharge side and the suction side of the uniaxial eccentric screw pomp 20.

The rotor 60 is a shaft body made of a metal formed into an n-thread (n=1 in this embodiment) male screw shape. The rotor 60 is formed so that a sectional shape thereof becomes a substantially true circular shape in sectional view at any position in the longitudinal direction. The rotor 60 is inserted into the through hole 54 formed in the above-mentioned stator 50, thereby being capable of eccentrically rotating freely in the through hole 54.

When the rotor 60 is inserted into the stator 50, an outer peripheral wall 62 of the rotor 60 and the inner peripheral surface 52 of the stator 50 are brought into close contact with each other at each tangent therebetween, and a fluid conveyance path 56 (cavity) is formed between the inner peripheral surface 52 of the stator 50 and the outer peripheral wall of the rotor 60. The fluid conveyance path 56 extends in a helical fashion in the longitudinal direction of the stator 50 and the rotor 60.

When the rotor 60 is rotated in the through hole 54 of the stator 50, the fluid conveyance path 56 advances in the longitudinal direction of the stator 50 while rotating in the stator 50. Therefore, when the rotor 60 is rotated, a fluid is sucked into the fluid conveyance path 56 from one end of the stator 50 and is transferred to the other end of the stator 50 in a state of being confined in the fluid conveyance path 56. Thus, the fluid can be discharged at the other end of the stator 50. The pump mechanism 30 according to this embodiment is used by rotating the rotor 60 in the forward direction, and can force-feed a viscous liquid sucked from the second opening 44 so that the liquid is discharged from the first opening 42.

The power transmission mechanism 70 is configured to transmit power from a driver 80 to the above-mentioned rotor 60. The power transmission mechanism 70 includes a power transmission part 72 and an eccentric rotation part 74. The power transmission part 72 is arranged at one end in the longitudinal direction of the casing 40. Further, the eccentric rotation part 74 is arranged in the intermediate part 46 formed between the power transmission part 72 and a stator mounting part 48. The eccentric rotation part 74 is a part connecting the power transmission part 72 and the rotor 60 to each other so that power can be transmitted. The eccentric rotation part 74 includes a connection shaft 76 formed of a coupling rod, a screw rod, or the like known as the related art. Therefore, the eccentric rotation part 74 transmits rotation power generated by operating the driver 80 to the rotor 60, thereby being capable of causing the rotor 60 to eccentrically rotate.

<<Details of Stator 50>>

Next, the details of the stator 50 are described. The stator 50 is the sliding member for pumps, which is configured to slide while being in contact with the rotor 60 that is another member along with the operation of the uniaxial eccentric screw pump 20. As described above, when the rotor 60 is inserted into the through hole 54 of the stator 50, the fluid conveyance path 56 serving as a flow path of a fluid is formed. Therefore, the stator 50 is arranged so that the inner peripheral surface 52 is exposed to the fluid conveyance path 56.

The stator 50 is a member containing a resin or a rubber as a main component and has a feature of containing metal powder. It is preferred that the content of the metal powder be adjusted in consideration of the detection accuracy of the detection device to be used for detection of the metal powder, such as a metal locator and an X-ray foreign matter inspection machine, and the decrease in physical properties of the resin or the rubber caused by blending the metal powder. In consideration of the detection accuracy of the detection device to be used generally and the decrease in physical properties caused by blending the metal powder, it is desired that the blending amount of the metal powder fall within a range of from 10% to 30% in terms of a weight ratio.

The size (average grain diameter) of the metal powder to be blended in the stator 50 may be any size. However, it is preferred that the size of the metal powder be adjusted in consideration of the influence on the detection accuracy of the detection device to be used for detection of the metal powder, such as a metal locator and an X-ray foreign matter inspection machine, and the decrease in physical properties of a resin or a rubber. In consideration of the detection accuracy of the detection device to be used generally and the decrease in physical properties caused by blending the metal powder, the size of the metal powder falls within a range of desirably from 0.1 μm to 300 μm, more desirably from 0.1 μm to 3 μm.

It is only necessary that the metal powder to be contained in the stator 50 be capable of being detected by the detection device for a metal as typified by a metal locator and an X-ray foreign matter inspection machine. Specifically, as the metal powder, for example, one kind of various metal powders such as iron (Fe), copper (Cu), zinc (Zn), cobalt (Co), nickel (Ni), samarium (Sm), and stainless steel (SUS) may be used, or two or more kinds thereof may be used in combination. Further, it is desired that the metal powder to be blended in the stator 50 be selected in consideration of the application of the uniaxial eccentric screw pump 20 and the relationship with a product to be conveyed. Specifically, in the case where the uniaxial eccentric screw pump 20 is used for force-feeding (conveying) food, it is desired that the metal powder be formed of a material, such as iron (Fe), which does not adversely affect a human body even when the metal powder is taken up into the body. In this embodiment, iron oxide ($Fe_3O_4$) is selected as the metal powder from the viewpoints of less effect on a human body through uptake, and high oxidation resistance and low reaction activity.

<<Detection Device 100>>

The detection device 100 is a device capable of detecting the presence of the metal powder. As illustrated in FIG. 1, the detection device 100 is arranged partially or entirely in a conveyance path 110 through which a fluid discharged from the uniaxial eccentric screw pump 20 is conveyed. With this, even when a wear substance and a flake of the stator 50 are generated and mixed in the fluid through use of the uniaxial eccentric screw pump 20 in an unintended usage state, the presence/absence of the wear substance can be detected.

As the detection device 100, a metal detection machine, an X-ray foreign matter detection machine, and the like can be used. In the case of using the metal detection machine, any of a coaxial type, an opposed type, or a permanent magnet type may be used. The metal detection machine has a characteristic that the detection sensitivity is decreased as the content of water and salt in an item to be inspected is larger. Further, the X-ray foreign matter detection device is configured to detect a foreign matter based on the difference in X-ray absorption amount. Hence there is a risk in that the detection sensitivity may be decreased for those having an X-ray absorption amount approximate to that of the metal powder. It is preferred that, as the detection device 100, a device capable of detecting the metal powder blended in the stator 50 with good accuracy be selected in consideration of the above-mentioned characteristics, the characteristics of a fluid to be conveyed (force-fed) by the uniaxial eccentric screw pump 20, the size of a wear substance, which are intended to be at least detected.

<<Control Device 120>>

The control device 120 is a device configured to determine whether or not a wear substance and a flake of the stator 50 are mixed in a fluid discharged from the uniaxial eccentric screw pump 20 based on the detection results of the detection device 100 described above. The control device 120 determines that a wear substance and the like are mixed in the fluid under the condition that the detection device 100 detects the presence of the metal powder.

<<Operation of Pump Operation State Detection System 10>>

Figure 3:
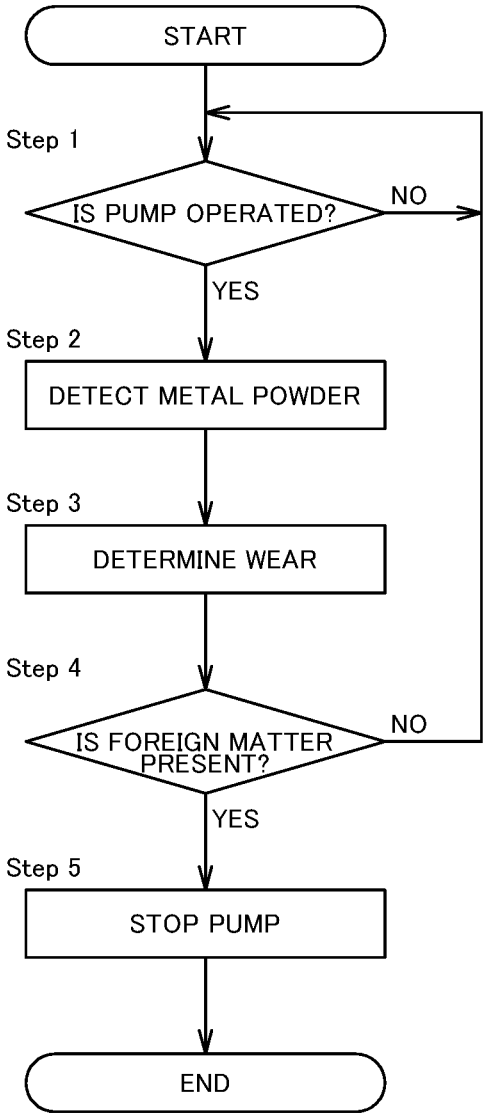
FIG. 3 is a flowchart for illustrating an example of operation of the pump operation state detection system illustrated in FIG. 1.

In what follows, the operation of the pump operation state detection system 10 is described with reference to the flowchart of FIG. 3. In the pump operation state detection system 10, first, it is confirmed whether or not the uniaxial eccentric screw pump 20 is operated by the control device 120 (step 1). When the uniaxial eccentric screw pump 20 is operated, the control flow proceeds to Step 2, and the detection device 100 detects metal powder in the fluid that is discharged from the uniaxial eccentric screw pump 20 and is passing through the conveyance path 110.

Then, in Step 3, wear determination is performed based on the detection results of metal powder that are obtained in Step 2. In the wear determination step, various determination conditions may be set, however in this embodiment, whether or not the metal powder is detected as a result of detection of the metal powder in Step 2 is set as the determination condition. Further, when the metal powder is detected, it is determined whether the wear of stator 50 has occurred to such a degree that there is a problem for quality maintenance of the fluid passing through the conveyance path 110, to thereby determine whether or not an abnormality has occurred. In other words, when the metal powder is not detected in Step 2, degradation in quality of the fluid, which may be caused by the wear of stator 50, is not assumed, and hence it is determined that no abnormality has occurred.

When it is determined that an abnormality has occurred in Step 3, the control flow proceeds from Step 4 to Step 5, and the operation of the uniaxial eccentric screw pump 20 is stopped. With this, the series of control flows is completed. Meanwhile, when it is determined that no abnormality has occurred in Step 3, the control flow is returned from Step 4 to Step 1, and the control flow of FIG. 3 is continued.

As described further above, the stator 50 of the preferred embodiment is made of a resin or a rubber and contains 10% to 30% of metal powder in terms of a weight ratio. In this way, even if a wear substance of the stator 50 is generated and mixed in the fluid flowing through the fluid conveyance path 56, due to the use of the uniaxial eccentric screw pump 20 in an unintended usage form, the mixing of the wear substance can be quickly and accurately detected and determined by the detection device 100 and the control device 120.

In the preferred embodiment, the stator 50 is tapered in an end surface on the discharge side and/or the suction side of the fluid in the stator 50. Therefore, cracks can be prevented from being formed by the influence of a discharge pressure or a suction pressure on the end surface on the discharge side and/or the suction side of the stator 50, thereby being capable of minimizing the mixing of a foreign matter such as the wear substance of the stator 50.

Figure 4:
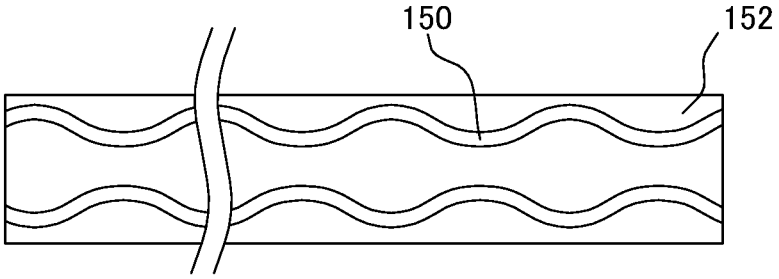
FIG. 4 is a cross-sectional view for illustrating a stator according to a modified example.

The stator 50, as described above, has a tubular external appearance, and the through hole 54 having a female screw shape is formed therein. Therefore, the thickness of the resin or the rubber in each portion is not uniform, but the present invention is not limited thereto. In an alternative embodiment, a stator 150 as illustrated in FIG. 4, which is made of a resin or a rubber having a uniform thickness in each portion and contains metal powder, may be used in place of the stator 50. In the alternative embodiment, as illustrated in FIG. 4, the stator 150 can be used by the same usage method as that of the stator 50 by holding the stator 150 with an outer casing 152 made of a metal, a resin, or the like.

Figure 5:
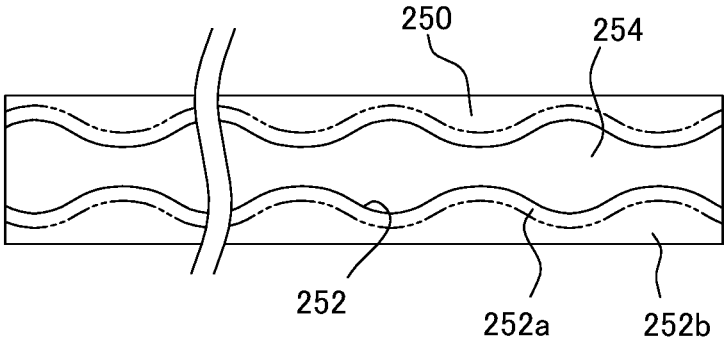
FIG. 5 is a cross-sectional view for illustrating a stator according to a modified example.

Further, the stator 50 contains metal powder in a substantially entire region instead of partial regions, but the present invention is not limited thereto. Specifically, it is assumed that the wear substance of the stator 50 is generated in a region on the inner peripheral surface 52 (sliding surface) side on which the stator 50 slides while being in contact with the rotor 60. Therefore, a stator 250 as illustrated in FIG. 5, which is molded so that the content of metal powder in a vicinity region 252*a* (region on a through hole 254 side with respect to the alternate long and two short dashes line in FIG. 5) of the inner peripheral surface 252 is higher than that in another region (outer peripheral region 252*b*: region located radially outward with respect to the alternate long and two short dashes line in FIG. 5), may be used in place of the stator 50.

Specifically, the content of the metal powder may be set to be smaller in the outer peripheral region 252*b* than in the vicinity region 252*a* in such a manner that the metal powder is contained into a layer forming the vicinity region 252*a* of the inner peripheral surface 252, whereas the metal powder is not contained into the outer peripheral region 252*b* located radially outward with respect to the vicinity region 252*a*. With such configuration, a foreign matter can be detected also in the stator 250 in the same way as in the case of adopting the stator 50 described above. In addition, the outer peripheral region 252*b* can be formed so as to be less liable to be broken. Further, with the configuration of the stator 250, the vicinity region 252*a* and the outer peripheral region 252*b* can be made of the same material, or the vicinity region 252*a* and the outer peripheral region 252*b* can be made of different materials. Note that, in the example illustrated in FIG. 5, the vicinity region 252*a* and the outer peripheral region 252*b* respectively have a one-layer structure. However, the present invention is not limited thereto, and any one or both of the vicinity region 252*a* and the outer peripheral region 252*b* may have a multi-layer structure.

In the above-mentioned embodiment, the metal detection machine, the X-ray foreign matter detection machine, and the like are exemplified as examples of the detection device 100. However, the present invention is not limited thereto, and any device may be used as long as the device can detect the presence of metal powder in the fluid flowing through the conveyance path 110. Specifically, capture means capable of capturing a substance containing a metal through use of a magnetic force, such as a magnet filter, may be arranged in the conveyance path 110, and a device capable of detecting the presence of metal powder in the fluid based on the capture state by the capture means may be used as the detection device 100. More specifically, a device capable of detecting a change in surface magnetic flux density in capture means such as a magnet filter may be arranged as the detection device 100, and the disturbance of the magnetic field may be detected based on a change in surface magnetic flux density, to thereby detect a foreign matter. Further, a camera such as a CCD camera may be installed in the vicinity of capture means such as the magnet filter, and a device configured to determine the presence/absence of wear powder through the use of an image obtained by photographing a filter portion may be used as the detection device 100. Even in the case of using those devices as the detection device 100, the presence/absence of a foreign matter involved in wear of the stator 50 can be detected in the same way as in the case of using the metal detection machine, the X-ray foreign matter detection machine, and the like.

In the above-mentioned embodiments, the uniaxial eccentric screw pump 20 is exemplified as an example of the pump forming the pump operation state detection system 10, and the stator 50 is exemplified as an example of the sliding member for the pump. However, the present invention is not limited thereto. That is, for example, in another pump such as a rotary pump, the sliding member for the pump, which is arranged so as to be exposed to the flow path of the fluid in the pump and slides while being in contact with another member along with operation of the pump, may contain metal powder as in the stator 50 described above.

Example 1

In this Example, a test of confirming a change in physical properties due to the configuration in which the metal powder is contained in the sliding member for the pump is conducted. In this Example, a rubber free of metal powder (content: 0%) is prepared as a sample A of Comparative Example. On the other hand, Samples B to D in which the content of iron oxide ($Fe_3O_4$), which is the metal powder in the rubber, is set to 30% by weight, 20% by weight, and 10% by weight are prepared. Further, the samples A to D are verified for tensile strength, elongation, and tearing strength. The results are summarized in Table 1 and illustrated in FIG. 6.

TABLE 1

| | Sample A | Sample B | Sample C | Sample D |
|---|---|---|---|---|
| Content of iron oxide [%] | 0 | 10 | 20 | 30 |
| Tensile strength [MPa] | 26.3 | 24.8 | 21.3 | 19.3 |
| Elongation [%] | 530 | 540 | 550 | 560 |
| Tearing strength [N/mm] | 61.5 | 59.8 | 58.9 | 51.2 |

Figure 6:
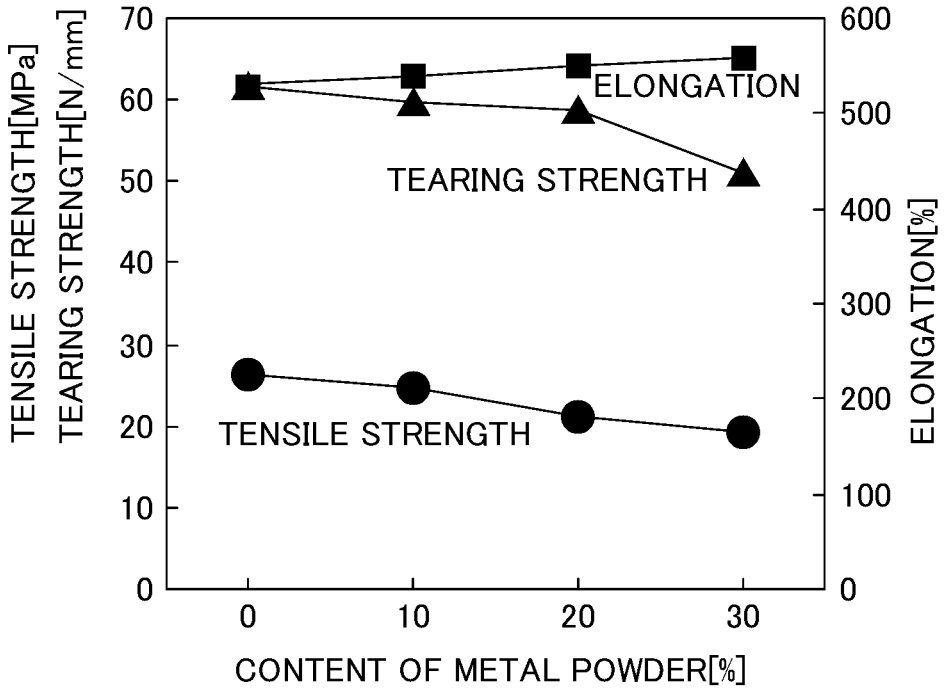
FIG. 6 is a graph for showing experimental data according to Example 1.

As shown in Table 1 and FIG. 6, the following tendency is observed. When the content of the metal powder (iron oxide) increases, the elongation value increases while the tensile strength and tearing strength are decreasing. Assuming the use as the sliding member for the pump such as the stator 50 of the uniaxial eccentric screw pump 20 according to the above-mentioned embodiment, the tensile strength is preferably 19 [MPa] or more, and the tearing strength is preferably 50 [N/mm] or more. From the viewpoints of tensile strength and tearing strength, based on such findings and experimental data of this Example, it has been found that the content of the metal powder in the sliding member for the pump is preferably 10% or more and 30% or less.

Example 2

Results of a detection test are hereinafter described. The detection test is conducted through use of test pieces prepared assuming the wear substance is generated from the rubber sliding member containing the metal powder. Rubber chips being the test pieces to be used in this Example each have a cubic shape, and respectively have a dimension measuring 3 mm, 2 mm, and 1 mm per side, as shown in Table 2. Further, the test piece of each size contains iron oxide ($Fe_3O_4$) as the metal powder. In this Example, the test pieces are prepared under such configuration that the content of the metal powder is set to 30% by weight, 20% by weight, and 10% by weight for each size. Further, as a Comparative Example, a rubber chip measuring 3 mm per side, which was free of metal powder, is also prepared.

Further, in this Example, as devices corresponding to the detection device 100, a metal detection machine (manufactured by Anritsu Industrial Solutions Co., Ltd.: Model No. KD8113AW) and an X-ray foreign matter detection machine (Anritsu Industrial Solutions Co., Ltd.: Model No. KD7405A) are prepared.

In this Example, as workpieces into which the test pieces are mixed, bean paste and mayonnaise, particularly in which the detection accuracy of the above-mentioned metal detection machine and X-ray foreign matter detection machine are assumed to become extremely low, are selected. In this Example, bean paste and mayonnaise are respectively supplied to a container made of polypropylene (PP) having a diameter of 35 mm and a height of 45 mm, and each test piece are mixed therein. The resultant is inspected by the metal detection machine and the X-ray foreign matter detection machine to confirm whether or not the presence of each test piece is detected. Table 2 summarizes the obtained results in each case.

TABLE 2

| | | Bean paste | | Mayonnaise | |
|---|---|---|---|---|---|
| Content of iron oxide [%] | Size of iron oxide [mm] | Metal detection machine | X-ray foreign matter detection machine | Metal detection machine | X-ray foreign matter detection machine |
| 30 | 3 | Detected | Not detected | Detected | Detected |
| | 2 | Detected | Not detected | Detected | Detected |
| | 1 | Detected | Not detected | Not detected | Detected |
| 20 | 3 | Detected | Not detected | Detected | Detected |
| | 2 | Detected | Not detected | Detected | Detected |
| | 1 | Detected | Not detected | Not detected | Detected |
| 10 | 3 | Detected | Not detected | Detected | Not detected |
| | 2 | Detected | Not detected | Detected | Not detected |
| | 1 | Detected | Not detected | Not detected | Not detected |
| 0 | 3 | Not detected | Not detected | Not detected | Not detected |

As shown in Table 2, in the case where the bean paste was used as a workpiece, the X-ray foreign matter detection machine was not able to detect any test piece, but the metal detection machine was able to detect all the test pieces. That is, not only the test piece measuring 3 mm per side and containing 30% of iron oxide, but also the test piece measuring 1 mm per side and containing 10% of iron metal, the smallest piece that contained the smallest amount of metal powder, are detected by the metal detection machine.

Meanwhile, in the case where mayonnaise is used as the workpiece, even when the content of the iron oxide in the test piece is any of 10% to 30%, the test pieces were detectable by the metal detection machine as long as the size of the test piece was 2 mm per side or more. Further, it has been found that, in the case of using the X-ray foreign matter detection machine, even when the size of the test piece is as small as about 1 mm, the test pieces are detectable as long as the content of the iron oxide is 20% or more.

From the above-mentioned results, it has been found that the test piece assuming a wear substance is detectable even in workpieces such as bean paste and mayonnaise in which the detection accuracy of the metal detection machine and the X-ray foreign matter detection machine are assumed to become extremely low. Furthermore, by selecting the metal detection machine and the X-ray foreign matter detection machine as the detection device 100 in consideration of the kind of workpieces, the minimum size of the wear substance intended to be detected, and the like, the detection accuracy may be optimized.

Embodiments of the present invention are applicable to a general sliding member for pumps that is arranged so as to be exposed to the flow path of a fluid in the pump such as the uniaxial eccentric screw pump or the rotary pump and slides while being in contact with another member along with operation of the pump. Further, the pump operation state detection system of the present invention is suitably applicable to, for example, the case where mixing of the wear substance of the sliding member needs to be avoided as in food and the like.

The invention claimed is:

1. A pump operation state detection system comprising:

a pump having a sliding member which comprises a rubber as a main component, and an amount of metal powder in a range of 10% to 30% by weight ratio;

a detection unit configured to detect a presence of the metal powder contained in the fluid discharged from the pump; and a control unit configured to perform a determination as to whether or not a wear substance is generated along with wear of the sliding member and is mixed in the fluid discharged from the pump, wherein the determination is performed by the control unit under a condition that the detection unit detects the presence of the metal powder.

2. The pump operation state detection system of claim 1, wherein the sliding member is arranged so as to be exposed to a fluid conveyance path through which the fluid flows.

3. The pump operation state detection system of claim 2, wherein the detection unit is disposed partially or entirely within the fluid conveyance path.

4. The pump operation state detection system of claim 1, wherein the sliding member is configured to slide while being in contact with another member of the pump when the pump is operating.

5. The pump operation state detection system of claim 1, wherein the sliding member is used as a stator in a uniaxial eccentric screw pump, said stator having an inner peripheral surface formed into a female screw shape.

6. The pump operation state detection system of claim 5, wherein the uniaxial eccentric screw pump further comprises a rotor formed into a male screw shape and configured to receive power to eccentrically rotate within the stator so as to form a fluid conveyance path between the inner peripheral surface of the stator and an outer peripheral wall of the rotor.

7. The pump operation state detection system of claim 1, wherein the resin or the rubber has a uniform thickness.

8. The pump operation state detection system of claim 1, wherein the sliding member has an inner peripheral surface configured to slide while being in contact with another member of the pump.

9. The pump operation state detection system of claim 8, wherein a content of the metal powder is higher in a vicinity region of the inner peripheral surface than other regions.

10. The pump operation state detection system of claim 9, wherein the other regions comprises an outer peripheral region which is located radially outward of the vicinity region.

11. The pump operation state detection system of claim 1, wherein the metal powder is selected from the group consisting of iron (Fe), copper (Cu), zinc (Zn), cobalt (Co), nickel (Ni), samarium (Sm), and stainless steel (SUS), or a combination of two or more thereof.

12. The pump operation state detection system of claim 11, wherein the metal powder comprises an iron oxide ($Fe_3O_4$) if the fluid discharged from the pump contains food.

13. The pump operation state detection system of claim 1, wherein a size of the metal powder falls within a range of 0.1 μm to 3 μm.

* * * * *